US005839677A

United States Patent [19]

Guerard

[11] Patent Number: 5,839,677

[45] Date of Patent: Nov. 24, 1998

[54] TRACK FOR MILLS

[75] Inventor: Norbert Guerard, Esneux, Belgium

[73] Assignee: Magotteaux International, Vaux-Sous-Chevremont, Belgium

[21] Appl. No.: 847,679

[22] Filed: Apr. 28, 1997

[30] Foreign Application Priority Data

Apr. 30, 1996 [LU] Luxembourg ..... 88753

[51] Int. Cl.[6] ..... B02C 15/00

[52] U.S. Cl. ..... 241/291; 241/115; 241/121; 241/300

[58] Field of Search ..... 241/110, 114, 241/115, 116, 117, 118, 119, 120, 121, 300, 291

[56] References Cited

U.S. PATENT DOCUMENTS

| | | | |
|---|---|---|---|
| 2,909,330 | 10/1959 | Hardinge | 241/121 |
| 3,957,212 | 5/1976 | Lohnherr . | |
| 4,919,341 | 4/1990 | Lohnherr | 241/18 |
| 5,100,068 | 3/1992 | Pingel | 241/121 |
| 5,114,082 | 5/1992 | Brundiek . | |
| 5,238,046 | 8/1993 | Guerard . | |

FOREIGN PATENT DOCUMENTS

| | | |
|---|---|---|
| 897 937 | 1/1984 | Belgium . |
| 405 518 | 6/1990 | European Pat. Off. . |
| 476 496 | 9/1991 | European Pat. Off. . |
| 2 262 476 | 2/1975 | France . |
| 1 507 580 | 5/1966 | Germany . |

*Primary Examiner*—John M. Husar
*Attorney, Agent, or Firm*—Schmeiser, Olsen & Watts

[57] ABSTRACT

A track for mills including a series of inner wearing segments and a series of outer wearing segments with a high resistance to wear. The upper surface of the inner wearing segments and the outer wearing segments provide two concentric circular runway paths moving beneath milling rollers in order to mill material tipped out onto the track. The inner and outer wearing segments are fixed removably to a sole with an outer edge and an inner edge defining a housing for the wearing segments.

6 Claims, 2 Drawing Sheets

TRACK FOR MILLS

FIELD OF THE INVENTION

The present invention relates to a track for mills which consists of several segments supported by a turntable and forming at least one circular runway path moving beneath milling rollers in order to mill the material tipped out onto the track.

BACKGROUND OF THE INVENTION

A mill of the sort targeted by the present invention is, for example, described in Patent EP 0476496 B1. There are also two-track mills with two concentric runway paths which move beneath two pairs of milling rollers. The tracks, both those with a single runway path and those with a double runway path, are generally made up of separate juxtaposed segments or quarters, which makes these elements easier to handle as they have a limited weight, because it should be pointed out that the total weight of an entire track may be of the order of several tens of tonnes. Moreover, in the event of one track segment accidentally becoming damaged, this segment can be replaced individually without the need to replace the entire track.

The major problem with mill tracks is wear. On account of the abrasive nature of the material being milled, the segments are actually exposed to rapid and intense wear and have to be made from very hard chromium alloy cast iron. From another standpoint, the segments have to be machined very accurately so as to be fixed correctly to the table of the mill and protect this table from any damage liable to arise during service. As these requirements are not mutually compatible, it is very difficult and very expensive to machine a track made of chromium alloy cast iron.

Wear on tracks with two runway paths is, furthermore, uneven in so far as the inner runway path becomes worn more quickly than the outer runway path. The shapes of the wear profiles on the runway paths are also different, and this results in differences in the effectiveness of grinding of one runway path with respect to the other and reduces the efficiency of the mill. In general, it is the state of wear of the inner runway path which is the governing factor in replacing the segments and it is often necessary to replace one track or one segment even though its region which forms the outer runway path could still be used for a while longer.

SUMMARY OF THE INVENTION

The object of the present invention is to provide a new track for mills which makes it possible to overcome these drawbacks, especially to provide a track with better resistance to wear and a track which displays more uniform wear.

To achieve this objective, the invention proposes a track for mills which is of the sort described in the preamble and which is characterized in that each segment consists of a sole made of machineable steel with an outer edge and an inner edge defining a housing for a wearing segment with a high resistance to wear fixed removably to the sole, the upper surface of the wearing segment forming the runway path or paths.

Thanks to the design of the attached wearing segments, it is possible to select for these materials which are harder and have a greater resistance to wear, without this choice being limited by the need to machine the base accurately. Thus it is possible not only to envisage ferrous alloys such as chromium alloy cast iron, but also composite components with a metallic matrix and with extremely hard inserts, for example made of various ceramics, for the wearing segments.

Likewise, for the sole, it is possible to select a steel which is easy to machine, given that the sole is not subjected to the milling wear. The sole can therefore be machined under optimum conditions so that it can be fixed correctly to the turntable which has to remain in perfect condition.

The wearing segments may be fixed to the sole using screws and clamping claws.

The edges of the sole may have bevelled parts forming dovetails for attachment to the wearing segments.

In the event of wear, all that is required is for the attached wearing segments to be replaced, it being possible for the sole to remain in place. The fact that screws and clamping claws are used to attach these segments allows them to be replaced easily and readily.

Given that the sole can remain in place, it effectively protects the table against any impacts with the wearing segments during replacement thereof.

According to an advantageous embodiment, the track may include a series of inner wearing segments and a series of outer wearing segments defining two concentric runway paths, while each sole includes a projecting middle rib in the shape of an arc of a circle separating the inner segments from the outer segments.

In this case, the inner segments and the outer segments can be replaced separately and the outer segment, more particularly, can remain in place until the outer runway path is completely worn. It is also possible to select a harder material for the inner segments in an attempt to ensure uniform wear on the two runway paths.

In general, the invention offers the possibility of selecting different materials for each of the wearing segments and of evening out the general wear profile by selecting a harder material in places where the track wears the most, and of making the wear profile more uniform, something which has a great influence on the efficiency of the mill.

BRIEF DESCRIPTION OF THE DRAWINGS

Other specific features of the invention will emerge from the detailed description of a preferred embodiment given hereinbelow by way of illustration with reference to the appended figures in which.

DETAILED DESCRIPTION OF THE INVENTION

Figure 1:
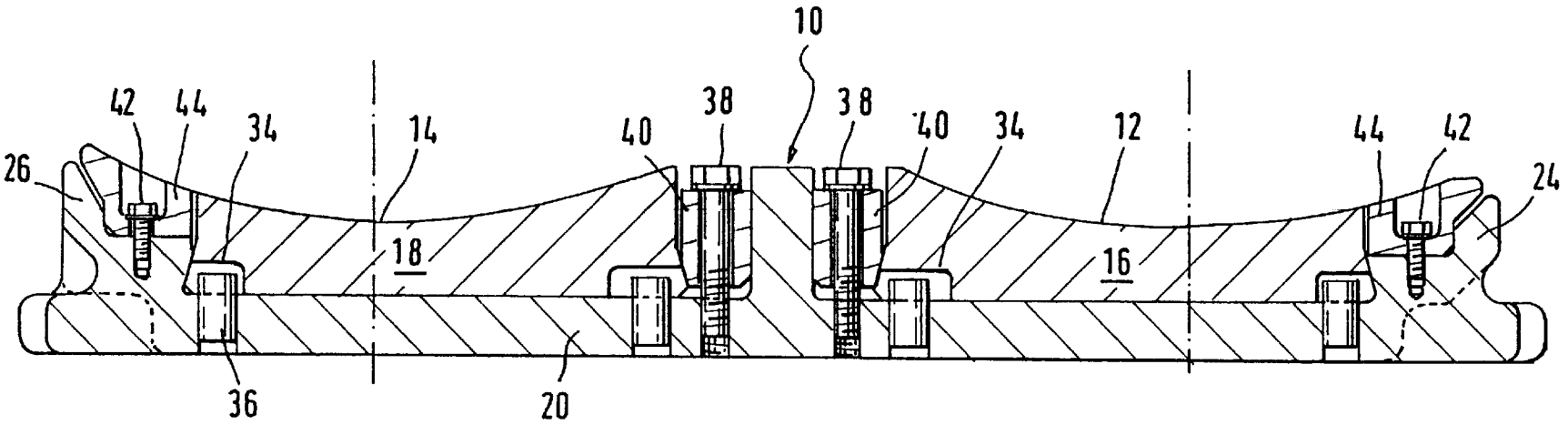
FIG. 1 diagrammatically represents a radial section through an annular track according to the present invention, and FIG. 2 diagrammatically represents a radial section through the sole.

The track represented in FIG. 1 and denoted overall by the reference 10 is fixed on an annular turntable, not shown. At its upper face it has two concentric annular runway paths of concave cross section, more specifically an inner runway path 12 and an outer runway path 14 which move beneath two pairs of milling rollers, not shown, with a convex running surface.

The two runway paths 12 and 14 are defined in a series of inner wearing segments 16 and a series of outer wearing segments 18, respectively, these segments being made of a material with a very good resistance to wear. The various segments are fixed into housings defined in a sole 20 (see also FIG. 2) which may also be segmented and which is made of steel which has been treated to obtain good mechanical properties and be easy to machine.

The sole 20 has a flat base 22 with an inner edge 24 and an outer edge 26 delimiting, together with a projecting middle rib 28 in the shape of an arc of a circle, the positions for the wearing segments 16 and 18. The inner and outer edges 24 and 26 preferably have inclined corners 30 and 32 respectively, interacting with corresponding bevelled corners of the segments 16 and 18 to define dovetails for securely attaching the wearing segments.

The wearing segments may, on their lower surface, have cavities 34 into which pins 36 protrude through the sole 20 to ensure correct positioning of the segments while these are being put in place and prevent any relative movement of the wearing segments with respect to the sole under the action of the driving torque transmitted by the sole and the segments to the bed of material to be milled and to the rollers.

The segments 16 and 18 may be attached and clamped using screws 38 and clamping claws 40 in the middle region and by means of the dovetail housings 30 and 32 on the periphery of the sole 20.

Figure 2:
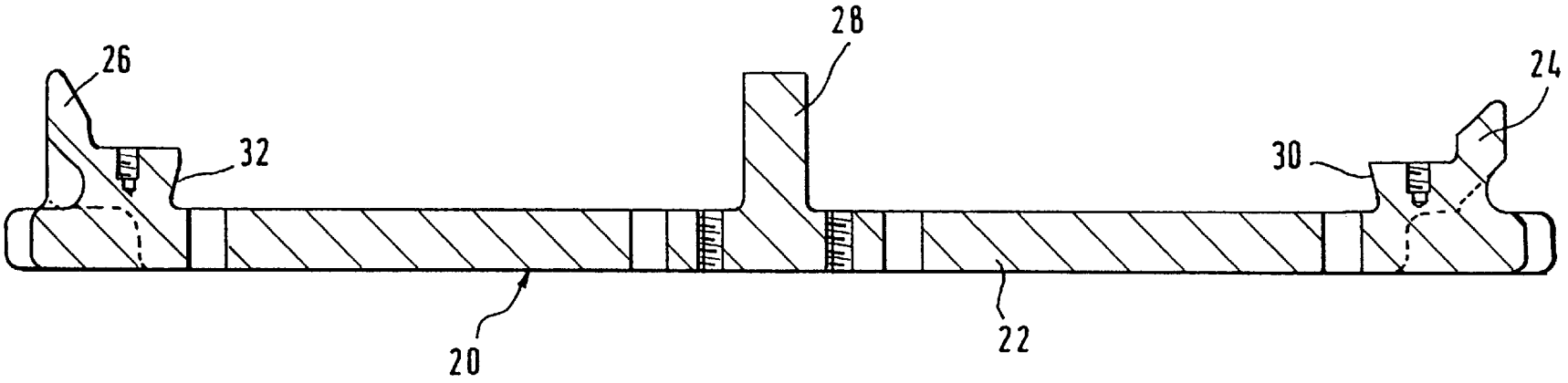

Although the invention has been described in detail with reference to FIGS. 1 and 2 in the context of its advantageous application to a track with two runway paths, it should be pointed out that it is not restricted to this application, and it also affords numerous advantages for tracks with a single runway path.

I claim:

1. Track for mills comprising:

a series of inner wearing segments and a series of outer wearing segments with a high resistance to wear, the upper surface of which defining two concentric circular runway paths moving beneath milling rollers in order to mill material tipped out onto the track, wherein said inner and said outer wearing segments are fixed separately and removably to a sole with an outer edge and an inner edge defining a housing for the wearing segments, said sole further including a projecting middle rib in the shape of an arc of a circle separating the inner wearing segments from the outer wearing segments.

2. Track according to claim 1, wherein the wearing segments are fixed to the sole using screws and clamping claws.

3. Track according to claim 1, wherein the edges of the sole have bevelled parts forming dovetails for attachment to the wearing segments.

4. Track according to claim 1, wherein the wearing segments are made of chromium alloy cast iron.

5. Track according to claim 1, wherein the wearing segments are composite components with a metallic matrix or with ceramic inserts with a high resistance to wear.

6. Track according to claim 1, wherein the sole is made of machinable steel.

* * * * *